US012006656B2

(12) United States Patent
Komura et al.

(10) Patent No.: US 12,006,656 B2
(45) Date of Patent: Jun. 11, 2024

(54) WORK VEHICLE, CONTROL DEVICE FOR WORK VEHICLE, AND METHOD FOR SPECIFYING DIRECTION OF WORK VEHICLE

(71) Applicant: Komatsu Ltd., Tokyo (JP)

(72) Inventors: Takaomi Komura, Tokyo (JP); Kazuya Ojiri, Tokyo (JP)

(73) Assignee: Komatsu Ltd., Tokyo (JP)

( * ) Notice: Subject to any disclaimer, the term of this patent is extended or adjusted under 35 U.S.C. 154(b) by 461 days.

(21) Appl. No.: 17/425,452

(22) PCT Filed: Mar. 27, 2020

(86) PCT No.: PCT/JP2020/014108
§ 371 (c)(1),
(2) Date: Jul. 23, 2021

(87) PCT Pub. No.: WO2020/203804
PCT Pub. Date: Oct. 8, 2020

(65) Prior Publication Data

US 2022/0090351 A1 Mar. 24, 2022

(30) Foreign Application Priority Data

Mar. 29, 2019 (JP) ..... 2019-068988

(51) Int. Cl.
*E02F 3/84* (2006.01)
*E02F 9/20* (2006.01)
*E02F 3/76* (2006.01)

(52) U.S. Cl.
CPC ..... *E02F 3/844* (2013.01); *E02F 9/2041* (2013.01); *E02F 3/7609* (2013.01)

(58) Field of Classification Search
CPC ..... E02F 3/844; E02F 9/2041; E02F 3/7609
See application file for complete search history.

(56) References Cited

U.S. PATENT DOCUMENTS

| | | | | |
|---|---|---|---|---|
| 5,560,431 | A | 10/1996 | Stratton | |
| 6,035,249 | A * | 3/2000 | Yamamoto | E02F 3/842 701/1 |
| 10,570,588 | B1 * | 2/2020 | Elkins | G06K 19/0723 |
| 2016/0122969 | A1 | 5/2016 | Noborio et al. | |
| 2018/0135277 | A1 | 5/2018 | Tsuji | |
| 2019/0368160 | A1 * | 12/2019 | Green | E02F 9/2037 |

FOREIGN PATENT DOCUMENTS

| | | | | |
|---|---|---|---|---|
| CN | 107532411 | A | 1/2018 | |
| JP | A-63-103135 | | 5/1988 | |
| JP | A-09-032032 | | 2/1997 | |
| JP | A-10-183675 | | 7/1998 | |
| JP | A-2011-247652 | | 12/2011 | |
| WO | WO-2014136278 | A1 * | 9/2014 | E02F 3/7613 |
| WO | WO 2015/083469 | | 6/2015 | |

OTHER PUBLICATIONS

English translation of WO-2014136278-A1 (Year: 2014).*

* cited by examiner

*Primary Examiner* — Anshul Sood
*Assistant Examiner* — Matthew Ho
(74) *Attorney, Agent, or Firm* — Fish & Richardson P.C.

(57) ABSTRACT

A pitch angle acquisition unit is configured to acquire a pitch angle of a vehicle body. A blade position calculation unit is configured to calculate a position of a blade with reference to the vehicle body. A traveling direction specification unit is configured to specify a traveling direction of the vehicle body based on the pitch angle and the position of the blade.

5 Claims, 7 Drawing Sheets

WORK VEHICLE, CONTROL DEVICE FOR WORK VEHICLE, AND METHOD FOR SPECIFYING DIRECTION OF WORK VEHICLE

CROSS-REFERENCE TO RELATED APPLICATIONS

This application is a National Stage application under 35 U.S.C. § 371 of International Application No. PCT/JP2020/014108, filed on Mar. 27, 2020, which claims priority to Japanese Patent Application No. 2019-068988, filed on Mar. 29, 2019. The contents of the prior applications are incorporated herein in their entirety.

The present invention relates to a work vehicle, a control device for a work vehicle, and a method for specifying a direction of a work vehicle.

BACKGROUND ART

Patent Literature 1 discloses a work vehicle in which a blade edge is caused to follow a design surface. According to the technique disclosed in the Patent Literature 1, a control device specifies a position of the work vehicle by using a global navigation satellite system (GNSS), and determines a target height of the blade based on the specified position.

CITATION LIST

Patent Literature

Patent Literature 1 WO 2015/083469 A1

SUMMARY OF INVENTION

Technical Problem

In the control using the GNSS as in the technique disclosed in Patent Literature 1, there is a possibility that radio waves of the GNSS cannot be received depending on the environment of the construction site and the position of the work vehicle cannot be specified. Therefore, it is considered that the position of the work vehicle is specified by autonomous navigation instead of the GNSS.

Meanwhile, since the work vehicle having the blade moves forward by pressing the blade against the excavation target, the work vehicle may travel in a state in which the front portion of the travel device floats due to a reaction force from the excavation target. At this time, there is a possibility that the control device erroneously recognizes a traveling direction of the work vehicle as an obliquely upward direction on the basis of a pitch angle read from an inertial measurement unit (IMU), and thus the blade cannot be appropriately controlled.

An object of the present invention is to provide a work vehicle, a control device for a work vehicle, and a method for specifying direction of a work vehicle that are capable of correctly specifying a traveling direction of the work vehicle when excavating the ground with a blade.

Solution to Problem

According to one aspect of the present invention, a control device for a work vehicle including work equipment supported by a vehicle body so as to be movable in up-down directions, the control device for the work vehicle includes:

a pitch angle acquisition unit that is configured to acquire a pitch angle of the vehicle body; a work equipment position calculation unit that is configured to calculate a position of the work equipment relative to the vehicle body; and a traveling direction specification unit that is configured to specify a traveling direction of the vehicle body based on the pitch angle and the position of the work equipment.

Advantageous Effects of Invention

According to the above aspect, the control device of the work vehicle can correctly specify the traveling direction of the work vehicle when excavating the ground with the blade.

DESCRIPTION OF EMBODIMENTS

First Embodiment

Hereinafter, embodiments will be described in detail with reference to the drawings.

Figure 1:
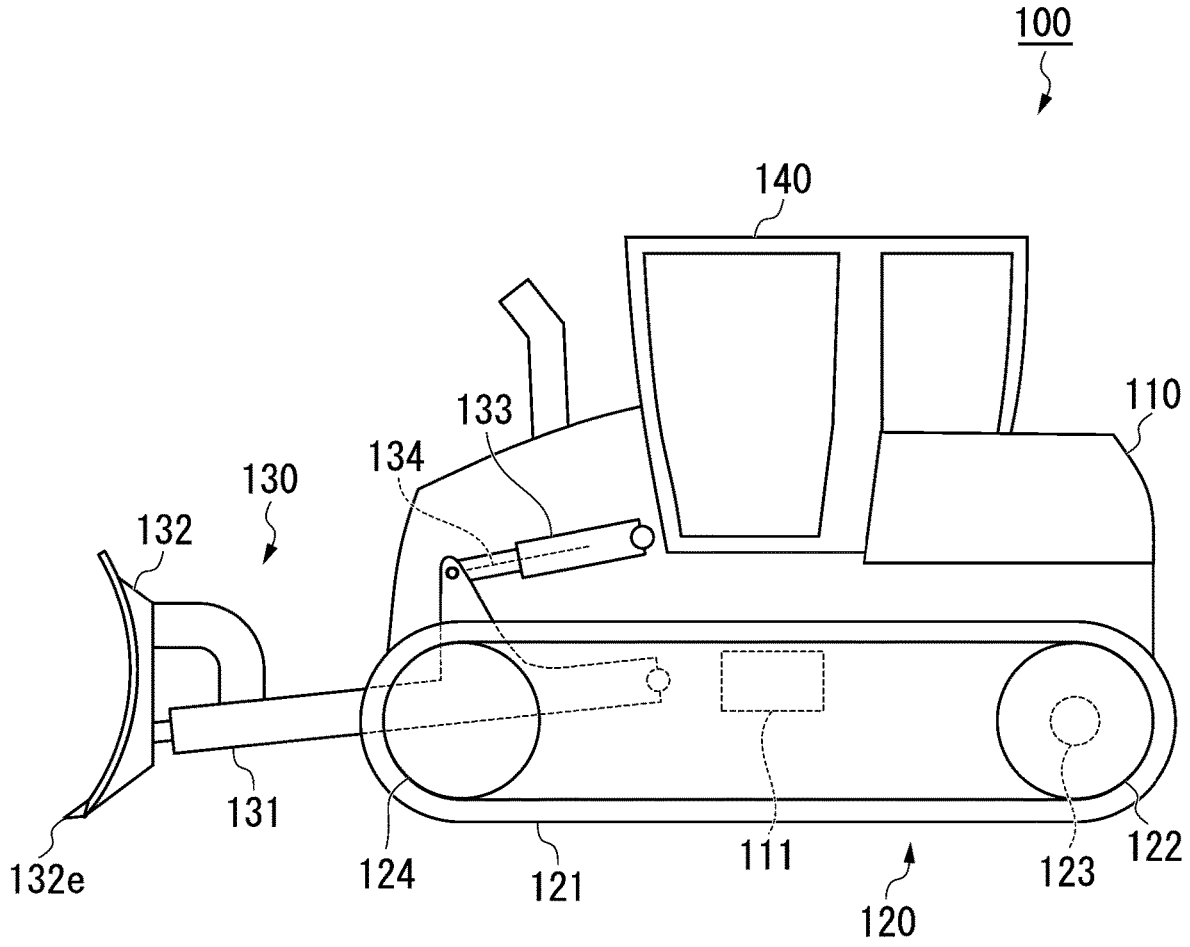
FIG. 1 is a side view of the work vehicle according to the first embodiment.

FIG. 1 is a side view of a work vehicle according to a first embodiment.

The work vehicle 100 according to the first embodiment is, for example, a bulldozer. The work vehicle 100 includes a vehicle body 110, a travel device 120, a work equipment 130, and a cab 140.

The travel device 120 is provided at a lower portion of the vehicle body 110. The travel device 120 includes a crawler 121, a sprocket 122, and an idler 124. The crawler 121 is rotated by driving of the sprocket 122, thereby the work vehicle 100 travels. A rotation sensor 123 is provided on a rotation shaft of the sprocket 122. The rotation sensor 123 measures the number of rotations of the sprocket 122. The number of rotations of the sprocket 122 can be converted into the speed of the travel device 120.

An IMU 111 is provided in the vehicle body 110. The IMU 111 measures inclination angles in the roll direction and the pitch direction of the vehicle body 110 and angular displacement in the yaw direction. The vehicle body coordinate system has an origin at a center of the idler 124, and is an orthogonal coordinate system represented by an X-axis extending in the front-rear directions of the vehicle body, a Y-axis extending in the left-right directions of the vehicle body, and a Z-axis extending in up-down directions of the vehicle body. The direction of rotation of the vehicle body about the X-axis is defined as a roll direction, the direction of rotation of the vehicle body about the Y-axis is defined as a pitch direction, and the direction of rotation of the vehicle body about the Z-axis is defined as a yaw direction.

The work equipment 130 is used for excavate and transport an excavation target such as earth. The work equipment 130 is provided at a front portion of the vehicle body 110. The work equipment 130 includes a lift frame 131, a blade 132, and a lift cylinder 133.

A base end portion of the lift frame 131 is attached to a side surface of the vehicle body 110 via a pin extending in a vehicle width direction. A tip end portion of the lift frame 131 is attached to a back surface of the blade 132 via a spherical joint. As a result, the blade 132 is supported so as to be movable in the up-down directions with respect to the vehicle body 110. Blade edge 132*e* are provided at a lower end portion of the blade 132. The lift cylinder 133 is a hydraulic cylinder. A base end portion of the lift cylinder 133 is attached to the side surface of the vehicle body 110. A tip end portion of the lift cylinder 133 is attached to the lift frame 131. By expanding and contracting of the lift cylinder 133 by the hydraulic oil, the lift frame 131 and the blade 132 are driven in the raising direction or the lowering direction.

The lift cylinder 133 is provided with a stroke sensor 134 that measures a stroke amount of the lift cylinder 133. The stroke amount measured by the stroke sensor 134 can be converted into a position of the blade edge 132*e* with reference to the vehicle body 110. Specifically, the rotation angle of the lift frame 131 is calculated based on the stroke amount of the lift cylinder 133. Since the shapes of the lift frame 131 and the blade 132 are known, the position of the blade edge 132*e* of the blade 132 can be specified from the rotation angle of the lift frame 131. The work vehicle 100 according to another embodiment may detect the rotation angle by another sensor such as an encoder.

The cab 140 is a space in which an operator rides and operates the work vehicle 100. The cab 140 is provided in an upper portion of the vehicle body 110.

Figure 2:
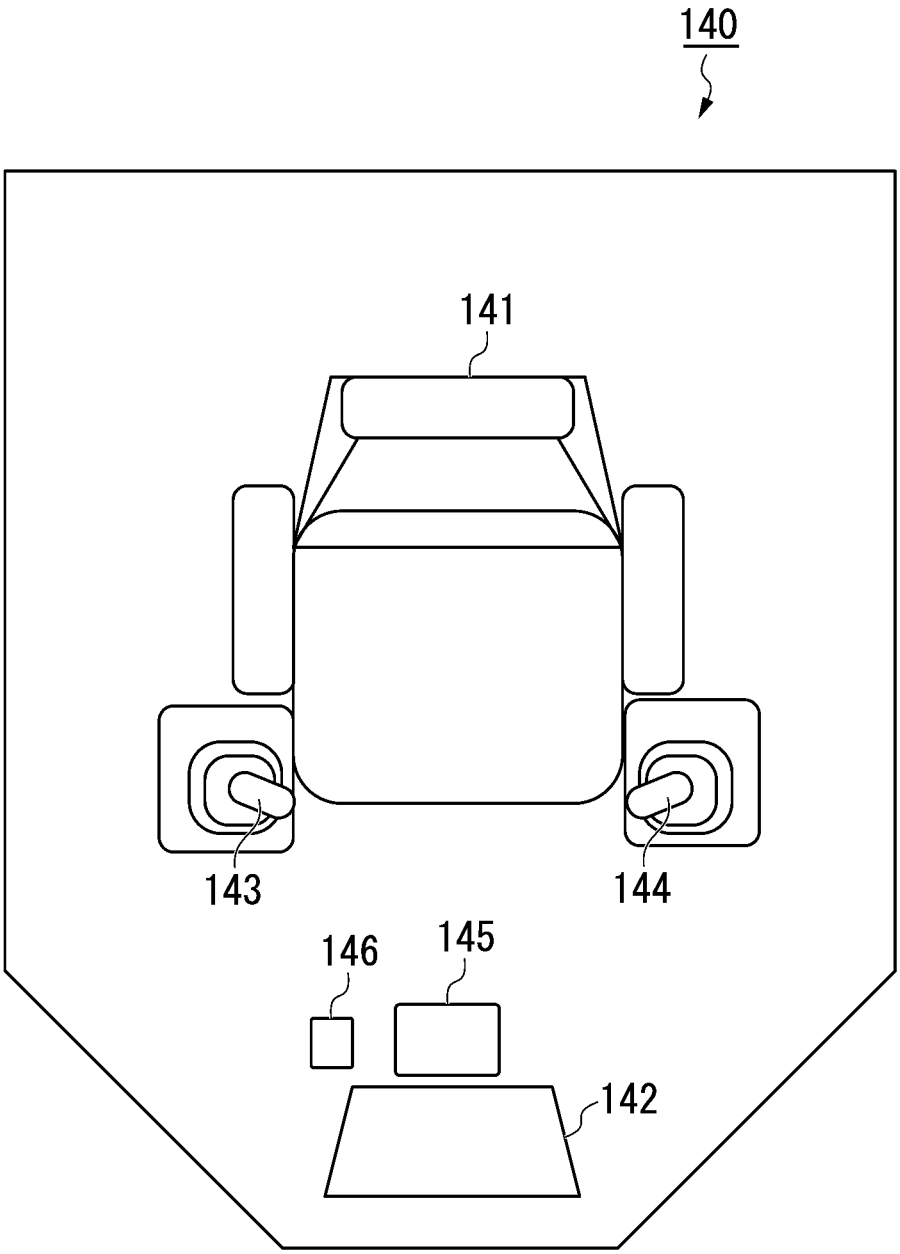
FIG. 2 is a diagram illustrating an internal configuration of a cab according to the first embodiment.

FIG. 2 is a diagram illustrating an internal configuration of the cab according to the first embodiment. A seat 141, a console 142, a work equipment operation lever 143, a travel operation lever 144, a brake pedal 145, and a decelerator pedal 146 are provided inside the cab 140.

An operation panel, instruments, and switches are attached to the console 142. The operator can check the state of the work vehicle 100 by visually recognizing the console 142. In addition, the operator sets a design surface indicating a target shape of an excavation target by operating the console 142.

The work equipment operation lever 143 is operated to set a moving amount of the raising operation or the lowering operation of the blade 132. The work equipment operation lever 143 receives the lowering operation by being tilted forward, and receives the raising operation by being tilted backward.

The travel operation lever 144 is operated to set a traveling direction of the travel device 120. The travel operation lever 144 receives a forward operation by being tilted forward, and receives a backward operation by being tilted backward. In addition, the travel operation lever 144 receives a left turning operation by being inclined leftward, and receives a right turning operation by being inclined rightward. The operator instructs the start and the end of the automatic blade control by operating the work equipment operation lever 143 or the travel operation lever 144 after setting the design surface on the console 142. For example, the operator can instruct the start and the end of the automatic blade control by operating a switch attached to the work equipment operation lever 143 after setting the design surface. After setting the design surface, the operator instructs the start of the automatic blade control by tilting the travel operation lever 144 forward, and then instructs the end of the automatic blade control by returning the travel operation lever 144.

The brake pedal 145 is operated to brake the travel device 120.

The decelerator pedal 146 is operated to reduce the rotational speed of the travel device 120.

<<Power System>>

Figure 3:
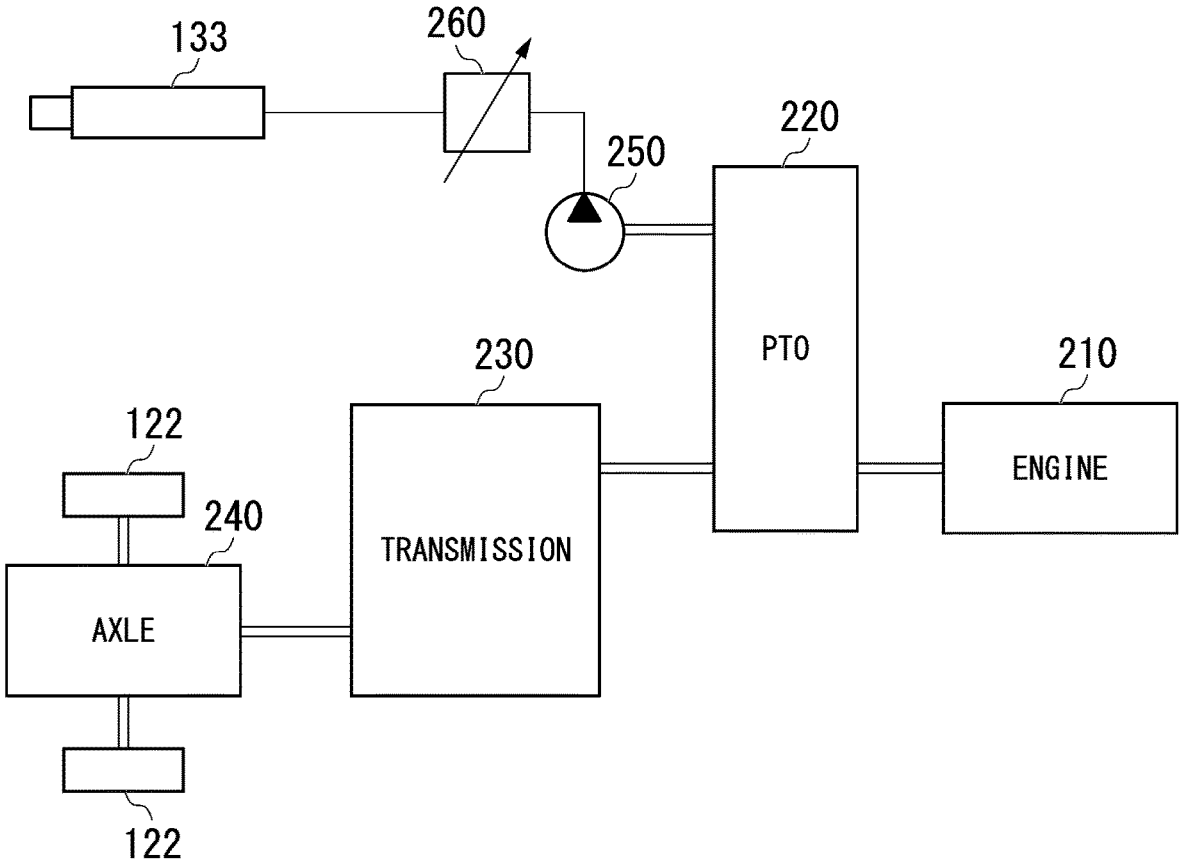
FIG. 3 is a schematic diagram illustrating a power system of the work vehicle according to the first embodiment.

FIG. 3 is a schematic view illustrating a power system of the work vehicle according to the first embodiment.

The work vehicle 100 includes an engine 210, a PTO 220 (Power Take Off), a transmission 230, an axle 240, a hydraulic pump 250, and a proportional control valve 260.

The engine 210 is, for example, a diesel engine.

The PTO 220 transmits part of the driving force of the engine 210 to the hydraulic pump 250. The PTO 220 distributes the driving force of the engine 210 to the transmission 230 and the hydraulic pump 250.

The transmission 230 shifts the driving force input to the input shaft and outputs it from the output shaft. The transmission 230 has an input shaft connected to the PTO 220 and an output shaft connected to the axle 240. That is, the transmission 230 transmits the driving force of the engine 210 distributed by the PTO 220 to the axle 240.

The axle 240 transmits the driving force output from the transmission 230 to the sprocket 122. As a result, the travel device 120 rotates.

The hydraulic pump 250 is driven by the driving force from the engine 210. Operating oil discharged from the hydraulic pump 250 is supplied to the lift cylinder 133 via the proportional control valve 260.

The proportional control valve 260 controls a flow rate of the operating oil discharged from the hydraulic pump 250. In addition to the proportional control valve 260, the hydraulic pump 250 may supply the operating oil to another supply destination such as a steering clutch (not illustrated) provided between the axle 240 and the sprocket 122.

<<Control Device>>

The work vehicle 100 includes a control device 300 for controlling the work vehicle 100. The control device 300 outputs a control signal to a fuel injection device of the engine 210, the transmission 230, and the proportional control valve 260 in accordance with an operation amount of each operation device (the console 142, the work equipment operation lever 143, the travel operation lever 144, the brake pedal 145, and the decelerator pedal 146) in cab 140.

Figure 4:
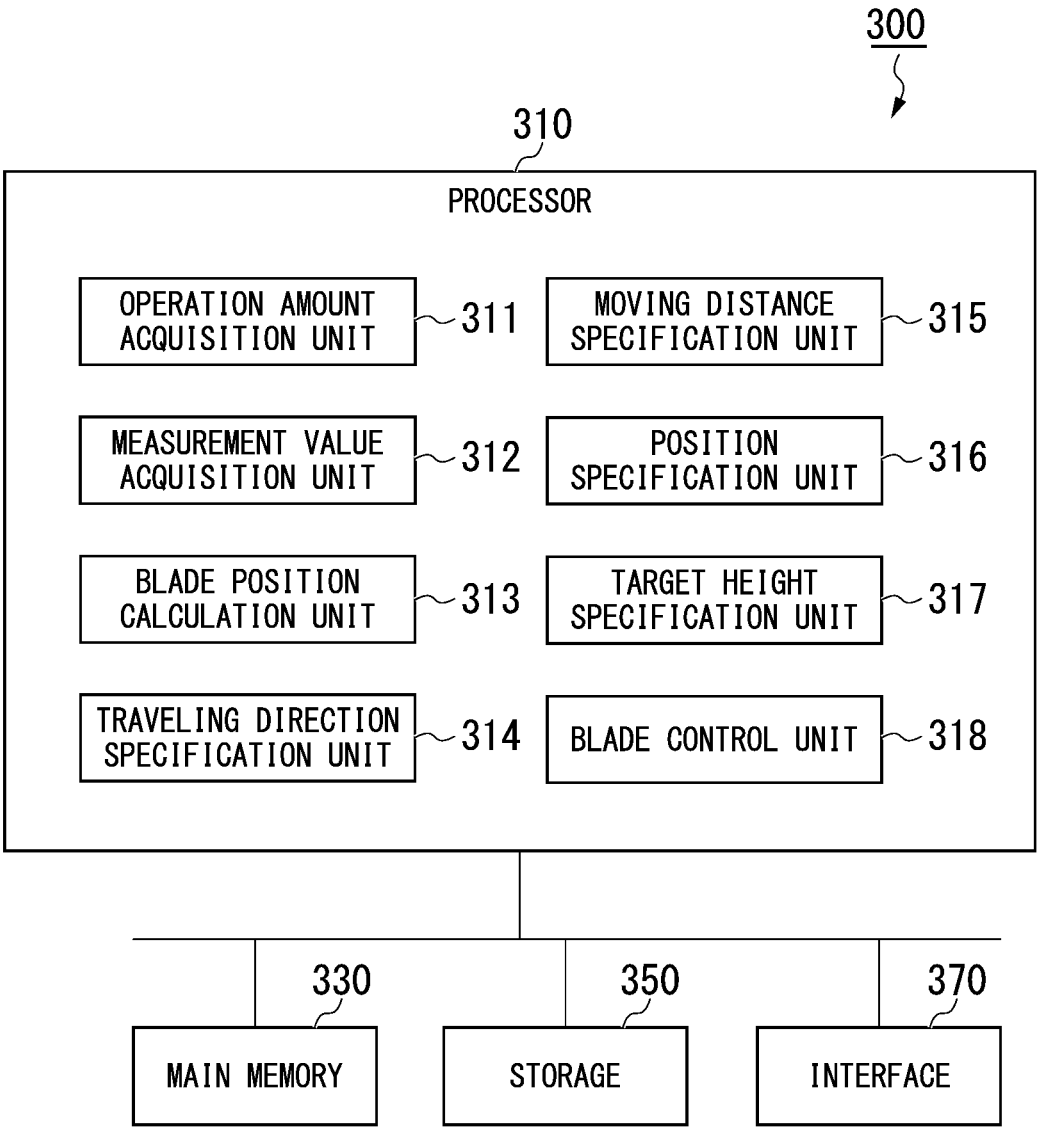
FIG. 4 is a schematic block diagram illustrating a configuration of a control device of the work vehicle according to the first embodiment.

FIG. 4 is a schematic block diagram illustrating a configuration of the control device of the work vehicle according to the first embodiment. The control device 300 is a computer including a processor 310, a main memory 330, a storage 350, and an interface 370.

The storage 350 is a non-transitory tangible storage medium. Examples of the storage 350 include a magnetic disk, a magneto-optical disk, a semiconductor memory, and the like. The storage 350 may be an internal medium directly connected to a bus of the control device 300, or may be an external medium connected to the control device 300 via the interface 370 or a communication line. The storage 350 stores a program for controlling the work vehicle 100. The design surface data stored in the storage 350 may be data defining only the gradient of the design surface. In addition, the design surface data is defined in an ad-hoc coordinate system described later.

In another embodiment, the control device 300 may include a custom LSI (Large Scale Integrated Circuit) such as a PLD (Programmable Logic Device) in addition to or instead of the above configuration. Examples of the PLD include a programmable array logic (PAL), a generic array logic (GAL), a complex programmable logic device (CPLD), and a field programmable gate array (FPGA). In this case, some or all of the functions implemented by the processor 310 may be implemented by the integrated circuit.

The processor 310 includes an operation amount acquisition unit 311, a measurement value acquisition unit 312, a blade position calculation unit 313, a traveling direction specification unit 314, a moving distance specification unit 315, a position specification unit 316, a target height specification unit 317, and a blade control unit 318, by running the program.

The operation amount acquisition unit 311 acquires a start command and an end command of the automatic blade control from the console 142.

The measurement value acquisition unit 312 acquires measurement values from the IMU 111, the rotation sensor 123, and the stroke sensor 134. That is, the measurement value acquisition unit 312 acquires measurement values of the yaw angle of the vehicle body 110, the roll angle of the vehicle body 110, the pitch angle of the vehicle body 110, the number of rotations of the sprocket 122, and the stroke amount of the lift cylinder 133. The measurement value acquisition unit 312 is an example of a pitch angle acquisition unit. Since the number of rotations of the sprocket 122 can be converted into the speed of the vehicle body 110, it can be said that the measurement value acquisition unit 312 is an example of a speed acquisition unit.

The blade position calculation unit 313 calculates the position of the blade edge 132*e* of the blade 132 with reference to the vehicle body 110 based on the measurement value of the stroke amount of the lift cylinder 133 acquired by the measurement value acquisition unit 312. That is, the blade position calculation unit 313 calculates the position of the blade edge 132*e* in the vehicle body coordinate system from the size information of the vehicle body 110 stored in advance and the measurement value of the stroke amount of the lift cylinder 133.

The traveling direction specification unit 314 specifies the traveling direction of the vehicle body 110 based on the position of the blade edge 132*e* calculated by the blade position calculation unit 313 and the measurement values of the yaw angle, the roll angle, and the pitch angle of the vehicle body 110 acquired by the measurement value acquisition unit 312.

Figure 5:
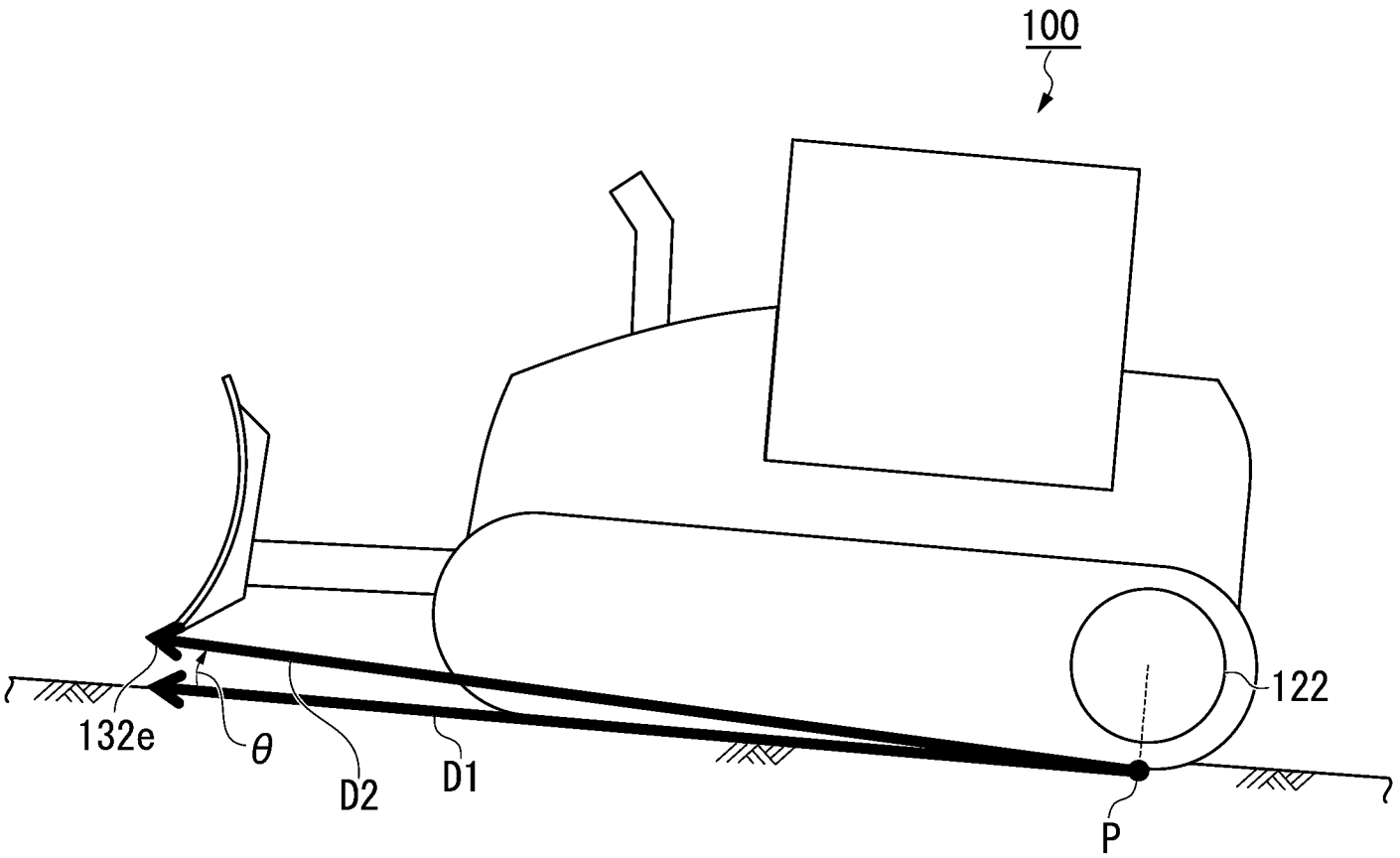
FIG. 5 is a first diagram illustrating a method for specifying a traveling direction of a vehicle.
Figure 6:
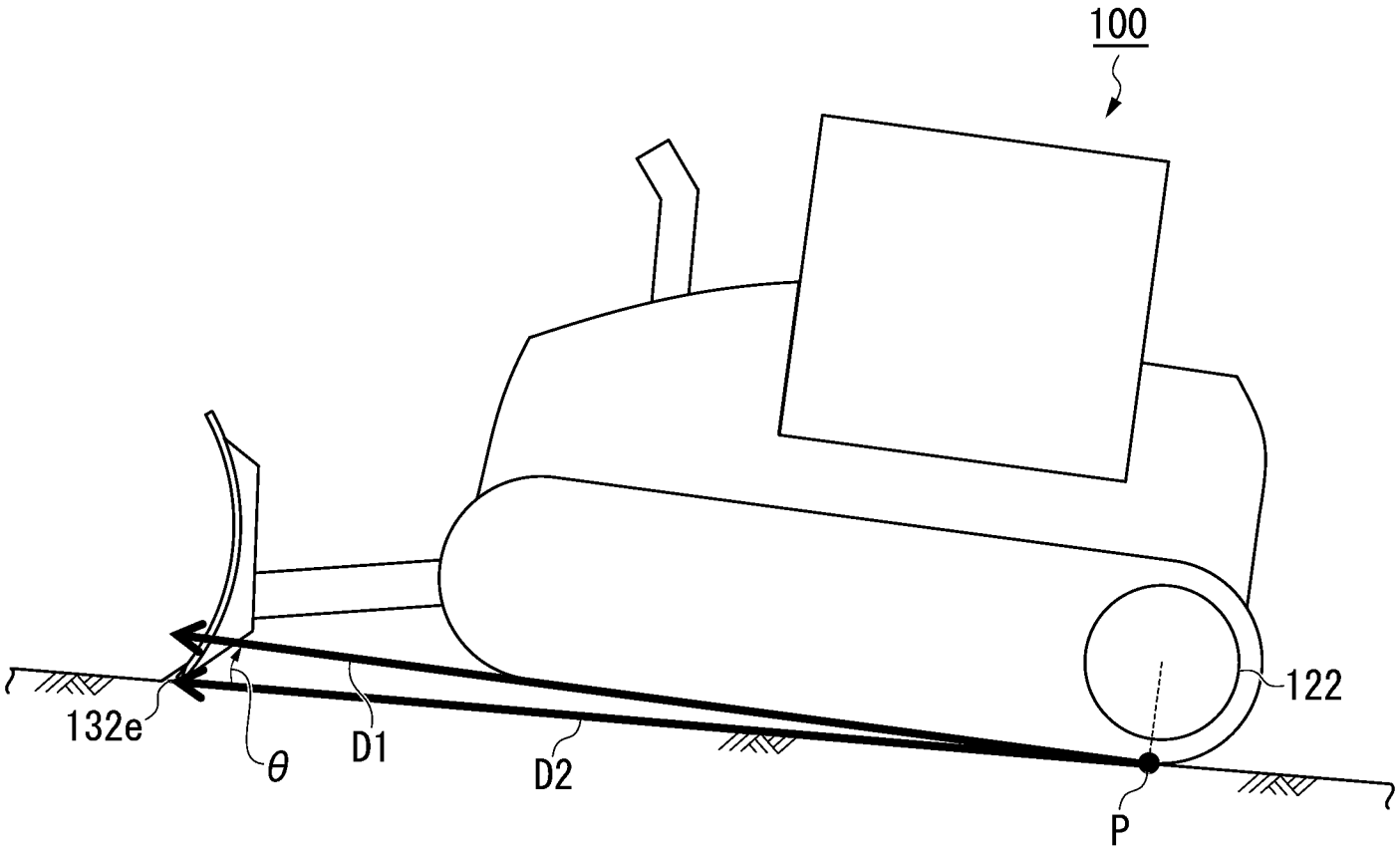
FIG. 6 is a second diagram illustrating a method for specifying a traveling direction of a vehicle.

FIG. 5 is a first diagram illustrating a method for specifying a traveling direction of a vehicle. FIG. 6 is a second diagram illustrating a method for specifying a traveling direction of a vehicle. Specifically, the traveling direction specification unit 314 determines whether or not an angle θ formed by a vehicle body front direction D1 and a direction D2 of a straight line connecting the position P of the crawler 121 (a ground contact portion) immediately below the sprocket 122 and the blade edge 132*e* in the vehicle body coordinate system is equal to or greater than 0 degrees. The angle θ being equal to or greater than 0 degrees indicates that the position of the blade edge 132*e* is above a bottom surface of the travel device 120 as illustrated in FIG. 5. On the other hand, the angle θ being less than 0 degrees indicates that the position of the blade edge 132*e* is below the bottom surface of the travel device 120 as shown in FIG. 6.

In a case where the angle θ is equal to or greater than 0 degrees, the traveling direction specification unit 314 specifies the direction D1 of the measurement value of the pitch angle of the vehicle body 110 as pitch direction components of the traveling direction of the vehicle body 110. On the other hand, in a case where the angle θ is less than 0 degrees, the traveling direction specification unit 314 specifies the direction obtained by adding the angle θ to the measurement value of the pitch angle of the vehicle body 110 as the pitch direction components of the traveling direction of the vehicle body 110.

The moving distance specification unit 315 specifies a moving distance of the vehicle body 110 during the predetermined control time based on the measurement value of the number of rotations of the sprocket 122 acquired by the measurement value acquisition unit 312. That is, the moving distance specification unit 315 specifies the moving distance by multiplying the control time by the traveling speed of the vehicle body 110 specified from the number of rotations of the sprocket 122.

The position specification unit 316 specifies the position of the vehicle body 110 based on the previous position of the vehicle body 110, the traveling direction specified by the traveling direction specification unit 314, and the moving distance specified by the moving distance specification unit 315. The position of the vehicle body 110 is represented by a coordinate system (hereinafter, referred to as an ad-hoc coordinate system) in which an initial position of the vehicle body 110 is set as an origin, the initial azimuth direction is set as an X-axis, a vertical direction is set as a Z-axis, and the direction orthogonal to the X-axis and the Z-axis is set as a Y-axis. The position of the ad-hoc coordinate system specified by the position specification unit 316 is stored in the main memory 330. The origin of the ad-hoc coordinate system may coincide with the origin of the vehicle body coordinate system at the initial position of the vehicle body 110. The ad-hoc coordinate system may be set at the start of the automatic blade control and may be deleted at the end of the automatic blade control.

The target height specification unit 317 specifies the target height of the blade edge 132*e* based on the position of the vehicle body 110 in the ad-hoc coordinate system stored in the main memory 330, the measurement value of the speed acquired by the measurement value acquisition unit 312, the traveling direction specified by the traveling direction specification unit 314, and the design surface data in the ad-hoc coordinate system stored in the storage 350.

The blade control unit 318 outputs a drive command for controlling the blade 132 to the proportional control valve 260 based on the position of the blade edge 132*e* calculated by the blade position calculation unit 313 and the target height specified by the target height specification unit 317. For example, the blade control unit 318 calculates the moving speed of the blade edge 132*e* from the time series of the position of the blade edge 132*e* calculated by the blade position calculation unit 313, and outputs a drive command so that the deviation between the height of the blade edge 132*e* after the control time and the target height becomes small when the blade edge 132*e* is moved at the current moving speed.

<<Automatic Blade Control Method>>

Figure 7:
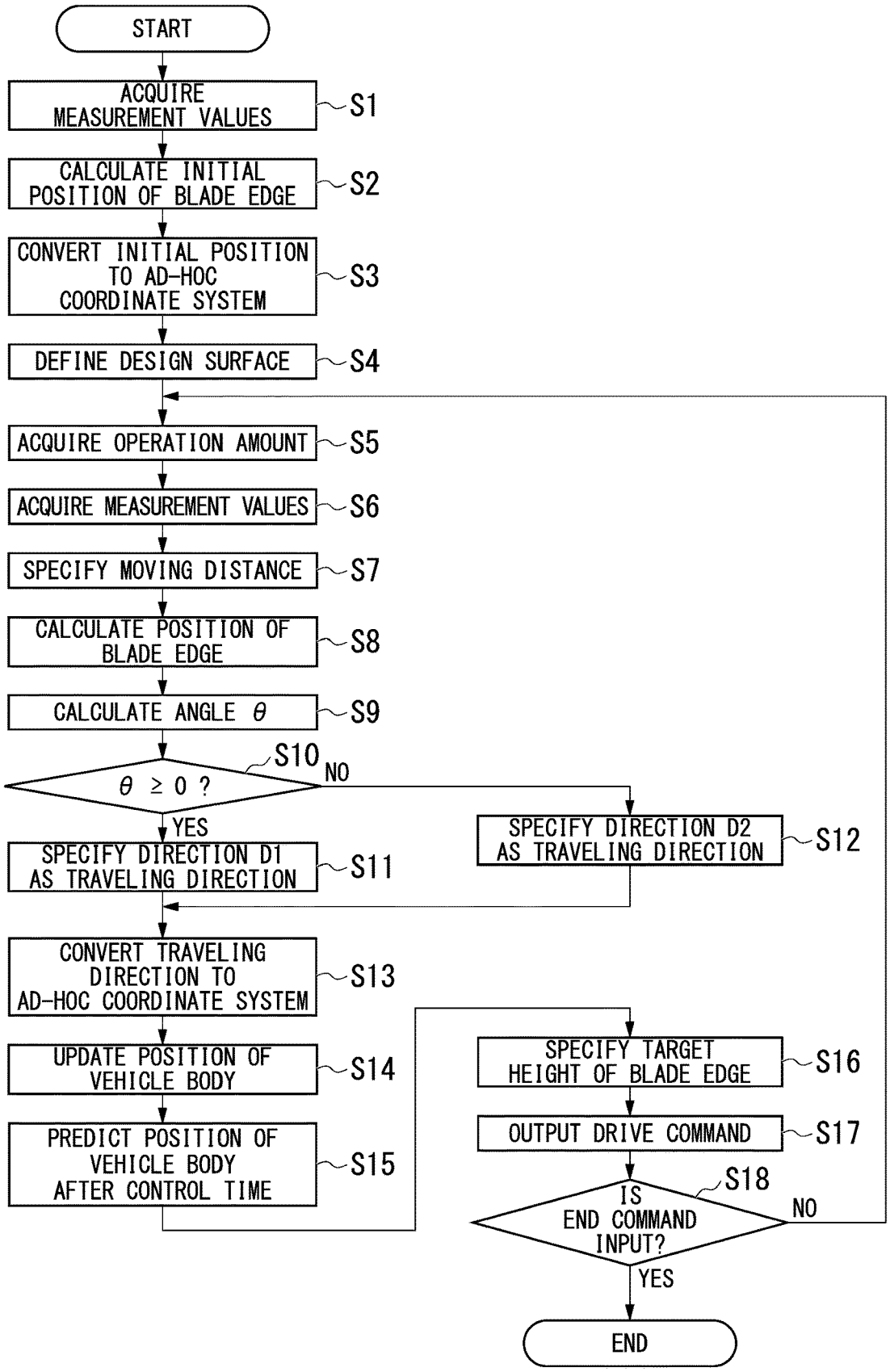
FIG. 7 is a flowchart illustrating an automatic blade control method according to the first embodiment.

Next, an automatic blade control method according to the first embodiment will be described. FIG. 7 is a flowchart illustrating an automatic blade control method according to the first embodiment.

When the operator moves the work vehicle 100 to the start position of the excavation work of the automatic blade control and moves the blade 132 to the excavation start height, the operator operates the console 142 and inputs the start command of the automatic blade control.

When the operation amount acquisition unit 311 of the control device 300 receives the start command of the automatic blade control, the measurement value acquisition unit 312 acquires measurement values from the IMU 111 and the stroke sensor 134 (step S1). Next, the position specification unit 316 defines an ad-hoc coordinate system based on the current position and the current azimuth direction of the vehicle body 110, and stores the position and the posture of the vehicle body 110 in the ad-hoc coordinate system in the main memory 330. That is, the position specification unit 316 sets the position of the vehicle body 110 to coordinates (0, 0, 0), and sets the azimuth direction of the vehicle body 110 to the X-axis direction.

Next, the blade position calculation unit 313 calculates an initial position of the blade edge 132*e* in the vehicle body coordinate system based on the measurement value of the stroke amount of the lift cylinder 133 acquired by the measurement value acquisition unit 312 (step S2). The blade position calculation unit 313 converts the initial position of the blade edge 132*e* from the vehicle body coordinate system to the ad-hoc coordinate system based on the measurement value of the IMU 111 acquired in step S1 (step S3). In other words, the blade position calculation unit 313 determines the initial position of the blade edge 132*e* in the ad-hoc coordinate system by specifying the vertical direction from the measurement value of the IMU 111 and rotating the initial position of the blade edge 132*e* by the deviation angle between the up-down directions of the vehicle body 110 and the vertical direction.

Next, the target height specification unit 317 defines, based on the design surface data, the design surface in the ad-hoc coordinate system so as to pass through the initial position of the blade edge 132*e* calculated in step S3 (step S4). The target height specification unit 317 stores the defined design surface in the main memory 330.

Next, the operation amount acquisition unit 311 acquires the operation amount of the travel operation lever 144 (step S5). The measurement value acquisition unit 312 acquires measurement values from the IMU 111, the rotation sensor 123, and the stroke sensor 134 (step S6). Next, the moving distance specification unit 315 specifies the moving distance of the vehicle body 110 in the control time based on the measurement value of the rotation sensor 123 acquired in step S6 (step S7).

Next, the blade position calculation unit 313 calculates the position of the blade edge 132*e* in the vehicle body coordinate system based on the measurement value of the stroke amount of the lift cylinder 133 acquired by the measurement value acquisition unit 312 (step S8). Next, based on the position of the blade edge 132*e* calculated in step S8, the traveling direction specification unit 314 calculates an angle θ formed by the vehicle body front direction D1 and a direction D2 of a straight line connecting the position P of the crawler 121 immediately below the sprocket 122 and the blade edge 132*e* (step S9). The traveling direction specification unit 314 determines whether or not the angle θ is equal to or greater than 0 degrees (step S10).

In a case where the angle θ is equal to or greater than 0 degrees (step S10: YES), the traveling direction specification unit 314 specifies the vehicle body front direction D1 as the traveling direction of the vehicle body 110 in the vehicle body coordinate system (step S11). On the other hand, in a case where the angle θ is less than 0 degrees (step S10: NO), the traveling direction specification unit 314 specifies the direction D2 of the straight line connecting the position P of the crawler 121 immediately below the sprocket 122 and the blade edge 132*e* as the traveling direction of the vehicle body 110 in the vehicle body coordinate system (step S12).

Next, the traveling direction specification unit 314 converts the traveling direction of the vehicle body 110 specified in the step S11 or the step S12 from the vehicle body coordinate system to the ad-hoc coordinate system based on the measurement value of the IMU 111 acquired in the step S6 (step S13).

The position specification unit 316 updates the position of the vehicle body 110 stored in the main memory 330 on the basis of the position of the vehicle body 110 in the ad-hoc coordinate system stored in the main memory 330, the moving distance specified in the step S7, and the traveling direction specified in the step S13 (step S14).

Next, the target height specification unit 317 predicts the position of the vehicle body 110 after the control time based on the moving distance specified in step S7, the traveling direction specified in step S13, and the position of the vehicle body 110 updated in step S14 (step S15). Next, the target height specification unit 317 specifies the target height of the blade edge 132*e* based on the position predicted in step S15 and the design surface stored in the main memory 330 in step S4 (step S16).

The blade control unit 318 outputs a drive command for controlling the blade 132 to the proportional control valve 260 based on the position of the blade edge 132*e* calculated in step S8 and the target height specified in step S16 (step S17).

Next, the operation amount acquisition unit 311 determines whether or not the end command of the automatic blade control is input to the console 142 (step S18). In a case where the end command of the automatic blade control is not input to the console 142 (step S18: NO), the control device 300 returns the process to the step S5 and continues the automatic blade control process.

On the other hand, in a case where the end command of the automatic blade control is input (step S18: YES), the control device 300 ends the automatic blade control process.

«Action and Effect»

As described above, according to the first embodiment, the control device 300 specifies the traveling direction of the vehicle body 110 based on the pitch angle of the vehicle body 110 and the position of the blade with respect to the vehicle body 110. As a result, as illustrated in FIG. 6, even when the work vehicle 100 travels in a state in which the front portion of the travel device 120 is lifted by the reaction force from the excavation target, the control device 300 can correctly specify the traveling direction of the work vehicle 100.

In addition, the control device 300 specifies the position of the vehicle on the basis of the speed of the vehicle body and the specified traveling direction. In this way, the control device 300 can specify the position of the work vehicle 100 by autonomous navigation. In addition, the control device 300 outputs a control signal for the blade 132 based on the target height of the blade 132 and the specified traveling direction. In this way, the control device 300 can realize automatic blade control by self-contained navigation. In addition, in another embodiment, the use of the specified position information is not limited to automatic blade control. For example, the control device 300 according to another embodiment may display the specified position information on the console 142.

Other Embodiments

In the above, although one embodiment has been described in detail with reference to the drawings, the specific configuration is not limited to the above, and various design changes and the like can be made. For example, in another embodiment, the order of the above-described processes may be appropriately changed. In addition, some of the processes may be executed in parallel.

The work vehicle 100 according to the above-described embodiment is a bulldozer, but is not limited thereto. For example, the work vehicle 100 according to another embodiment may be another work vehicle such as a grader and a wheel loader having work equipment such as a bucket. In the case where the work vehicle 100 is a wheel loader, the travel device 120 is wheels. Therefore, the direction D1 is the direction of the straight line connecting the ground contact portion of front wheels and the ground contact portion of rear wheels. Therefore, the direction D2 is the direction of the straight line connecting the ground contact portion of the rear wheels and the blade edge 132*e*.

The control device 300 according to the above-described embodiment determines whether to set the traveling direction as the direction D1 or the direction D2 based on the angle θ formed by the direction D1 and the direction D2, but is not limited thereto. For example, the control device 300 according to another embodiment may determine whether to set the traveling direction as the direction D1 or the direction D2 based on whether the position of the blade edge 132*e* is above the bottom surface of the travel device 120. In addition, the position of the blade edge 132*e* in the vehicle body coordinate system is determined based on the measurement value of the stroke sensor 134. Therefore, the control device 300 according to another embodiment may determine whether the traveling direction is the direction D1 or the direction D2 based on whether or not the measurement value of the stroke sensor 134 is equal to or greater than a threshold value.

The control device 300 according to the above-described embodiment stores design surface data in the storage 350, but is not limited thereto. For example, the control device 300 according to another embodiment may receive the design surface data from the outside of the vehicle body by a communication device (not illustrated) provided in the vehicle body.

INDUSTRIAL APPLICABILITY

According to the above disclosure of the present invention, the control device of the work vehicle can correctly specify the traveling direction of the work vehicle when excavating the ground with the blade.

The invention claimed is:

1. A control device for a work vehicle, the work vehicle including work equipment that is supported by a vehicle body and movable in up-down directions, the control device comprising:

a processor configured to:

acquire a pitch angle of the vehicle body;

calculate a position of the work equipment relative to the vehicle body;

specify a traveling direction of the vehicle body based on the pitch angle and the position of the work equipment;

acquire a speed of the vehicle body;

specify a position of the vehicle body based on the speed and the traveling direction of the vehicle body;

specify a target height of an excavation target at the specified position of the vehicle body based on design surface data indicating a target shape of the excavation target; and output a control signal of the work equipment based on the target height and the traveling direction, wherein the processor is further configured to:

based on the position of the work equipment being below a ground contact portion of a travel device of the vehicle body, specify the traveling direction of the vehicle body as a direction extending from the ground contact portion to the position of the work equipment position, and based on the position of the work equipment being above the ground contact portion, specify the traveling direction of the vehicle body as a direction according to the pitch angle.

2. The control device according to claim 1, wherein the processor is configured to:

determine a deviation angle defined between a plane of the ground contact portion and the direction extending from the ground contact point to the position of the work equipment;

based on the deviation angle being less than zero, determine that the position of the work equipment is below the ground contact portion of the travel device of the vehicle body; and based on the deviation angle being greater than or equal to zero, determine that the position of the work equipment is above the ground contact portion of the travel device of the vehicle body.

3. The control device for a work vehicle according to claim 2, wherein the processor is configured to, based on the deviation angle being less than zero, specify the traveling direction of the vehicle body by adding the deviation angle to the pitch angle.

4. A work vehicle comprising:

a vehicle body;

work equipment supported by the vehicle body so as to be movable in up-down directions; and the control device according to claim 1.

5. A method for specifying a direction of a work vehicle, the work vehicle including work equipment that is supported by a vehicle body and movable in up-down directions, the method comprising:

measuring a pitch angle of the vehicle body;

calculating a position of the work equipment with respect to the vehicle body;

determining a traveling direction of the vehicle body based on the pitch angle and a position of the work equipment;

acquiring a speed of the vehicle body;

specifying a position of the vehicle body based on the speed and the traveling direction of the vehicle body;

specifying a target height of an excavation target at the specified position of the vehicle body based on design surface data indicating a target shape of the excavation target; and outputting a control signal of the work equipment based on the target height and the traveling direction, wherein determining the traveling direction of the vehicle body comprises:

based on the position of the work equipment being below a ground contact portion of a travel device of the vehicle body, specifying the traveling direction of the vehicle body as a direction extending from the ground contact portion to the position of the work equipment position, and based on the position of the work equipment being above the ground contact portion, specifying the traveling direction of the vehicle body as a direction according to the pitch angle.

* * * * *